US008740191B2

(12) United States Patent
Litcher

(10) Patent No.: US 8,740,191 B2
(45) Date of Patent: Jun. 3, 2014

(54) LABORATORY JACK

(75) Inventor: Stephen Greg Litcher, Buffalo Grove, IL (US)

(73) Assignee: Ace Laser Tek, Inc., Buffalo Grove, IL (US)

( * ) Notice: Subject to any disclaimer, the term of this patent is extended or adjusted under 35 U.S.C. 154(b) by 54 days.

(21) Appl. No.: 13/493,584

(22) Filed: Jun. 11, 2012

(65) Prior Publication Data

US 2012/0313059 A1 Dec. 13, 2012

Related U.S. Application Data

(60) Provisional application No. 61/495,716, filed on Jun. 10, 2011.

(51) Int. Cl.
*B66F 3/22* (2006.01)

(52) U.S. Cl.
USPC ..... 254/122; 354/88; 354/126

(58) Field of Classification Search
USPC ..... 254/88, 122, 126
See application file for complete search history.

(56) References Cited

U.S. PATENT DOCUMENTS

| | | | | |
|---|---|---|---|---|
| 3,623,707 | A | 11/1971 | Klopp | |
| 3,782,713 | A * | 1/1974 | Yount | 269/297 |
| 4,941,797 | A * | 7/1990 | Smillie, III | 414/462 |
| 5,419,534 | A | 5/1995 | Vesely | |
| 5,445,353 | A * | 8/1995 | Sakamoto | 248/421 |
| 6,050,546 | A | 4/2000 | Peschmann et al. | |
| 6,302,380 | B1 | 10/2001 | Ultimo, Sr. et al. | |
| 6,375,161 | B2 | 4/2002 | Garceau | |
| 6,431,319 | B1 | 8/2002 | Myers et al. | |
| 6,527,251 | B1 | 3/2003 | Garceau | |
| 6,607,181 | B2 | 8/2003 | Garceau | |
| 6,695,289 | B1 | 2/2004 | Mickael | |
| 6,769,668 | B2 | 8/2004 | Siglock | |
| 7,055,802 | B1 * | 6/2006 | Jones et al. | 254/122 |
| 7,111,825 | B2 | 9/2006 | Landsberger et al. | |
| 2008/0224107 | A1 | 9/2008 | Polins et al. | |

FOREIGN PATENT DOCUMENTS

| | | |
|---|---|---|
| GB | 2423760 | 6/2006 |

OTHER PUBLICATIONS

Laboratory Jack-Laboratory Jack Exporter & Manufacturer, Delhi, India; http://crownlab.tradeindia.com/ Exporters_Suppliers/Exporter4968.62509/ Laboratory-Jack, (1 pg.); dated Aug. 16, 2010.
United Scientific—Laboratory Jack; http://www.bldsci.com/ProductDetails.asp?ProductCode=USMP108, (1 pg.); dated Aug. 16, 2010.

(Continued)

*Primary Examiner* — Lee D Wilson
*Assistant Examiner* — Shantese McDonald
(74) *Attorney, Agent, or Firm* — Blanchard & Associates

(57) ABSTRACT

A laboratory jack having a scissors-type jack assembly connected to upper and lower platforms includes guide members and thrust bearings or rollers, which provide improved stability across a longer stroke than previous laboratory jacks. One laboratory jack includes upper and lower tiers of scissor assemblies comprised of scissor arms and guide rods disposed between the ends of each of the upper and lower scissor assemblies. The guide rods are carried by cross-brace members that are connected to and extend between opposing portions of the scissor assemblies, and the guide rods slide through a through bore in at least one of the cross-brace members. The scissor assemblies include rollers at the interface between laterally shifting ends of the scissor arms and an adjacent platform.

13 Claims, 5 Drawing Sheets

(56) References Cited

OTHER PUBLICATIONS

Laboratory Apparatus—Melting Point Apparatus, Leak Test Apparatus, Friability Test Ap . . . ; http://www.classicscientific.org/laboratory-apparatus.html, (1 pg.); dated Aug. 16, 2010.

VWR COM—Product Page; https://www.vwrsp.com/catalog/product/index.cgi?catalog_number=12000 . . . , (2 pg.); dated Jul. 23, 2010.

Fisher Scientific—Search Results; http://www.fishersci.com/wps/portal/SEARCHRESULTS?keyWord=lab+ja . . . , (2 pgs); dated Jul. 23, 2010.

Lab jack Search Newport; http://search.newport.com/?i=1;q=lab+jack;q1=Manual+Positioning;q2ln+ . . . , (5 pgs.); dated Jul. 23, 2010.

Laboratory Jacks and Jiffy-Jack Apparatus Positioners—Cole-Parmer Cata . . . ; http://www.coleparmer.com/catalog/product_view.asp?sku=0805720, (3 pgs.); dated Jul. 23, 2010.

Laboratory Jacks and Polycarbonate Lab Jack—Cole Parmer Catalog; http://www.coleparmer.com/catalog/product_view.asp?sku=0805550, (2 pgs.); dated Jul. 23, 2010.

Jiffy-Jack Apparatus Positioners Search Results Jiffy-Jack Apparatus Posit . . . ; http://www.coleparmer.com/catalog/product_index.asp?cls=17734, (2 pgs.); dated Jul. 23, 2010.

Lab Jack—Laboratory Scissors Jack; http://www.labdepotinc.com/Product_Details~id~334~pid~12639.aspx, (1 pg.); dated Jul. 23, 2010.

* cited by examiner

LABORATORY JACK

CROSS REFERENCE TO RELATED APPLICATIONS

This application claims the benefit of U.S. Provisional Patent Application No. 61/495,716, filed on Jun. 10, 2011, which is hereby incorporated by reference herein in its entirety.

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates to a laboratory jack with improved stability over a larger range of motion.

2. Description of the Background of the Invention

There are many devices designed for lifting and/or lowering objects in a controlled manner. Usually called lifts or jacks, such devices span a wide range of applications from lifting very heavy objects, such as automobiles, to the controlled lifting and placement of very small objects. There is also a wide range of basic designs for such jacks. For example, some jacks have a vertical actuator that moves a load platform directly up and down by means of a linear actuator, e.g., a hydraulic piston or a vertically oriented worm drive having a threaded rod that is connected directly to the platform to move it up and down.

Another common type of jack is a scissors jack. Generally a scissors jack includes a base and a lifting platform that are interconnected by a number of lift links or scissor arms connected in a crossing pattern and a drive actuator that is oriented transverse to the direction of lift, i.e., horizontally. The drive actuator moves the ends of the scissor arms toward or away from each other so as to cause the scissor arms to pivot about each other at a pivotable connection point thereby moving the lifting platform upwardly and downwardly. In its most basic state, and as the term will be used variously throughout this application, a scissor assembly has two scissor arms that cross each other and are connected by a pivot located at a central region of both scissor arms, such as a pin extending through both scissor arms. The upper ends of the scissor arms move up or down from a fixed base that supports the lower ends of the scissor arms depending on the rotation of the arms with respect to each other. A scissors jack assembly as used herein includes one or more such scissor assemblies.

One specific application for which lifts are often used is in a laboratory. So called laboratory jacks are often used to position relatively small objects supported thereon at a selected position at a relatively high accuracy. FIG. 1 shows a typical prior art laboratory jack that is a scissors-type jack.

The laboratory jack has a bottom plate for resting on a support surface, such as a table, and a top plate for supporting an item to be moved up and/or down. Interconnecting the top plate and the bottom plate is a dual column, two-tiered scissors-type lift assembly. The lift assembly has a left side column and a right side column, which are substantially identical to each other and are interconnected by cross-bracing members such that the left side column and the right side column move in parallel tandem at all times.

Each column has two levels or tiers, an upper scissor assembly and a lower scissors assembly, wherein each scissor assembly is made of two scissor arms, such as elongated rigid links, that are pivotally connected to each other at the centers thereof. The lower ends of the scissor arms of each upper scissor assembly are pivotally connected to the upper ends of the scissor arms of the lower scissors assembly, whereby when one scissor assembly is pivoted, it causes the other scissor assembly to pivot in the same manner. The lower end of one of the scissor arms in each lower scissor assembly is pivotally connected in a fixed position to the bottom plate, and the lower end of the other scissor arm of each lower scissor assembly is free to slide laterally across the bottom plate toward and away from the fixed connection. Similarly, the upper end of one of the scissor arms of each upper scissor assembly is pivotally mounted in a fixed position to the underside of the top plate, and the upper end of the other scissor arm of each upper scissor assembly is free to slide toward and away from the fixed connection along the underside of the top plate.

The lower end of the laterally shiftable scissor arm of each lower scissor assembly is slidably connected to a guide track formed of a vertical rail having an elongated slot therein by a pin or wheel that slides along the slot. The slot limits the lateral movement or travel distance of the laterally shiftable scissor arm and also holds the lower end of such scissor arm in lateral alignment with the fixed lower end of the other scissor arm.

Each connection of the upper and lower ends of the scissor arms and left and right side columns is substantially identical thereto, which thereby maintains all of the scissor arms of each respective column in a single plain of motion. The left side column and the right side column are linked by a number of cross-bracing members, such as rods or bars. For example, the left and right lower shiftable ends of the lower scissor assemblies are connected by a first rod, the respective left and right lower fixed pivotable ends of the lower scissor assemblies are interconnected by a second rod, and the central pivot points of the lower scissor assemblies are connected by yet another rod.

The laboratory jack is actuated up and down by a threaded rod oriented substantially perpendicular to the direction of motion of the top plate and bottom plate, i.e. horizontally where the top plate moves vertically. The threaded rod is connected to and extends through two opposing rod mount blocks, which connect the lower ends of the upper scissor arms with the upper ends of the lower scissor arms. The threaded rod has a threaded connection with at least one of the rod mount blocks. When the threaded rod is twisted in a first direction, the rod threads urge the two rod mount blocks together, which causes each of the upper scissor assemblies and lower scissor assemblies to pivot about their respective central pivot points thereby extending the scissors-type jack assembly vertically upwardly and moving the top plate up. Twisting the threaded rod drive in the opposite direction then allows the reverse action to occur, thereby moving the top plate downwardly.

Although the prior art laboratory jacks as described herein are sufficient to move an object up and down in a controlled manner, these laboratory jacks are often limited by a combination of the distance of travel available, the amount of weight that can be supported, and the overall stability of the laboratory jack under larger weight and larger travel distances. The inventor of the present application has sought to provide a laboratory jack that can be used for high tolerance applications and that can provide increased stability for larger weights over longer travel distances.

SUMMARY OF THE INVENTION

In one embodiment, a laboratory jack having a first support plate, a second support plate, and a scissors jack assembly disposed between and connected to the first and second support plates is disclosed. The scissors jack assembly comprises a first scissor assembly and a second scissor assembly, which are substantially identical, spaced apart, and parallel to each other, and first and second connection members, which are spaced apart and connect opposing positions on the first and second scissor assemblies. A linear drive is connected to the scissors jack assembly and actuates the scissors jack assembly to drive the second support plate toward and away from the first support plate. The laboratory jack further includes a guide member extending from the first connection member to the second connection member. The guide member is spaced between the first and second scissors assemblies and fixedly attached to the first connection member on one end and movably attached to the second connection member, wherein the second connection member slides along the guide member as the scissors jack assembly lowers or raises the second support plate.

In another embodiment, a laboratory jack comprising having a base platform and a load platform is disclosed. The laboratory jack also includes a scissors jack assembly disposed between and connected to the base platform and the load platform for lowering and raising the load platform from the base platform. The scissors jack assembly includes a first linear actuator column spaced apart from a second linear actuator column. The first linear actuator column having a first upper scissor assembly operatively connected to a first lower scissor assembly, and the second linear actuator column having a second upper scissor assembly operatively connected to a second lower scissor assembly. First and second cross-brace members are spaced apart and connect the first linear actuator column with the second linear actuator column at the connections of the lower scissor assemblies to the upper scissor assemblies. A linear drive means is associated with the scissors jack assembly and aligned transverse to the vertical direction, wherein actuation of the linear drive means causes the scissors jack assembly to raise or lower the load platform. The laboratory jack further includes a guide member extending from the first cross-brace member to the second cross-brace member. The guide member is fixedly attached to the first cross-brace member and extending through a bore hole associated with the second cross-brace member, wherein the second cross-brace member slides along the guide member as the scissors jack assembly lowers or raises the load platform.

In a further embodiment, a laboratory jack having a first support plate, a second support plate, and a scissors jack assembly disposed between and connected to the first and second support plates is disclosed, The scissors jack assembly includes a first scissor assembly and a second scissor assembly, which are substantially identical, spaced apart and parallel to each other and connected by at least one cross-brace member connecting opposing positions on the first and second scissor assemblies. The laboratory jack also includes a drive means for actuating the scissors jack assembly to drive the second support plate toward and away from the first support plate. Further, a roller is associated with the first scissor assembly, The roller is disposed at a laterally translating interface between the first scissor assembly and the first support plate, wherein the scissor assembly rolls across the first support plate on the roller.

Other aspects and advantages of the present invention will become apparent upon consideration of the following detailed description.

DETAILED DESCRIPTION OF THE DRAWINGS

Figure 1:
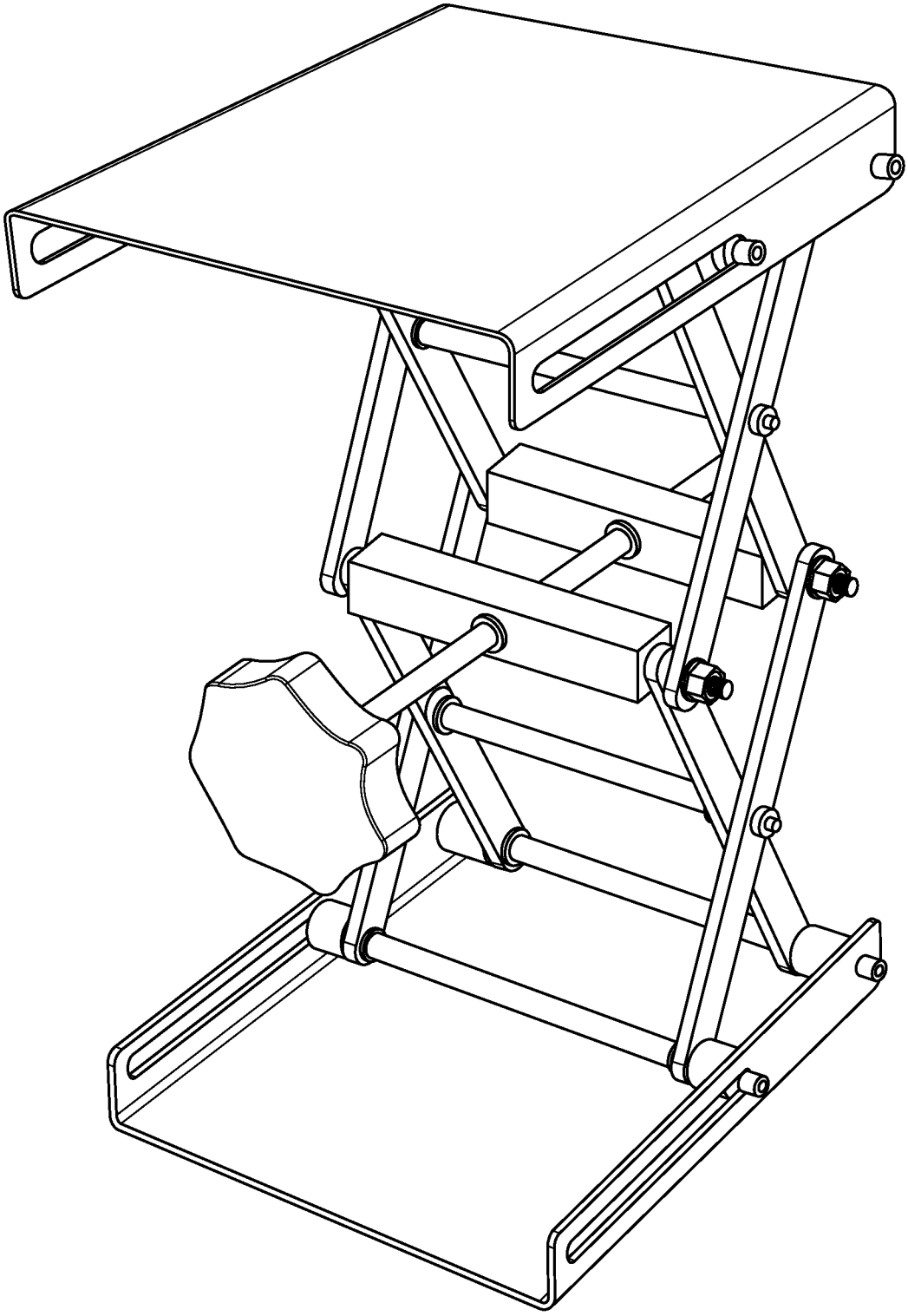
FIG. 1 (Prior Art)
FIG. 1 is an isometric view of a prior art laboratory jack as described previously herein.

According to some aspects, an improved laboratory jack is disclosed, which includes a scissors-type jack assembly for extension and retraction in a vertical direction having at least one tier of parallel spaced apart scissor assemblies connected by one or more cross-bracing members that cause the scissor assemblies to move in parallel tandem when actuated by a drive assembly. The scissor assemblies are further maintained in a preferred parallel vertical orientation by one or more guide rods that connect corresponding portions of the two scissor assemblies and that extend perpendicular to the direction of extension and retraction of the scissors-type jack assembly parallel to a direction of translation of the ends of scissor arms of the scissor assemblies. At least one of the cross-bracing members has a receiver means for slidably receiving the guide rod such that the cross-bracing member slides back and forth along the guide rod. The receiver means preferably consists of a through borehole in the cross-bracing member that slidably receives the guide rod therethrough. In one embodiment, the laboratory jack has at least two interconnected tiers of parallel spaced apart scissor assemblies, wherein a pair of parallel spaced apart guide rods and a linear drive means disposed between the guide rods are carried by cross-bracing members that connect the lower ends of scissors arms of an upper tier of scissor assemblies with respective upper ends of a lower tier of scissor assemblies. The linear drive means preferably includes a worm gear or threaded rod that is mounted to the cross-bracing members in such manner as to urge the cross-bracing members together and apart in a plane perpendicular to the direction of extension and retraction of the scissors-type jack assembly. Other aspects will become more apparent with reference to the following detailed description of the embodiments shown in the drawings.

Figure 4:
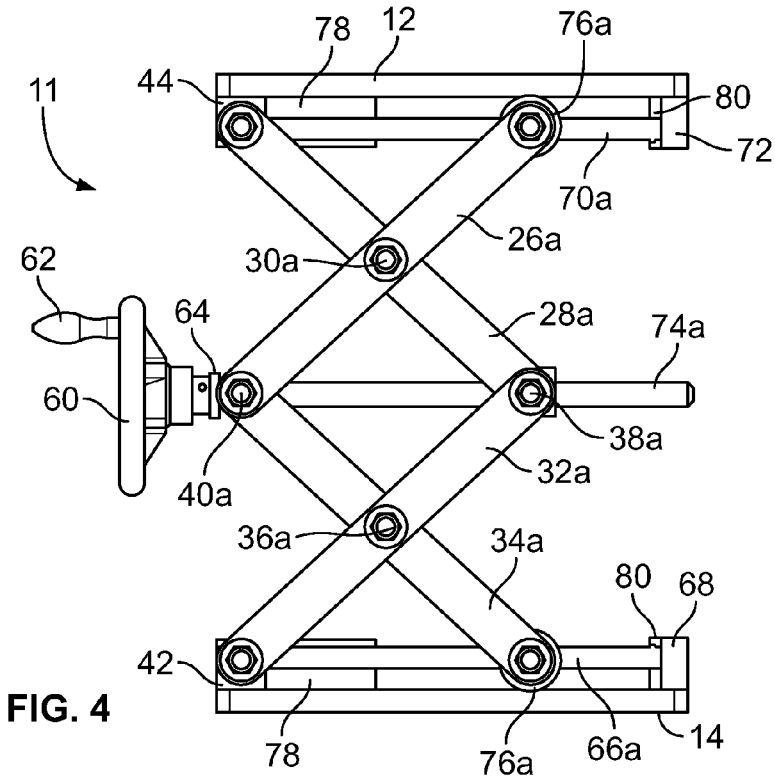
FIG. 4 is a right side view of the laboratory jack in a partially extended, intermediate height position, the left side view being substantially a mirror image thereof.
Figure 5:
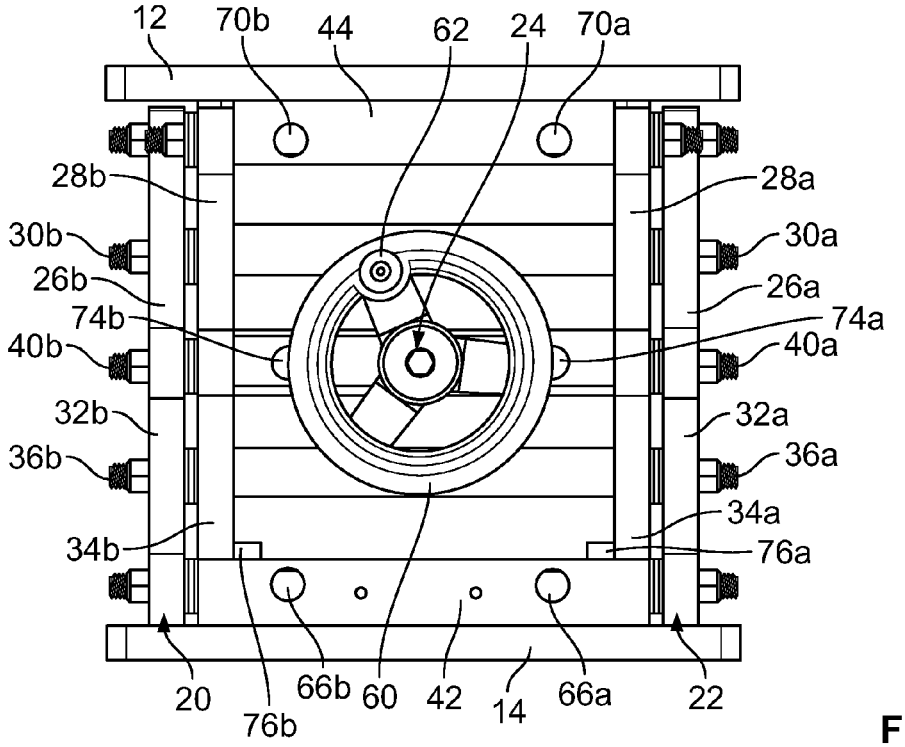
FIG. 5 is a front view of the laboratory jack in a fully retracted position.
Figure 6:
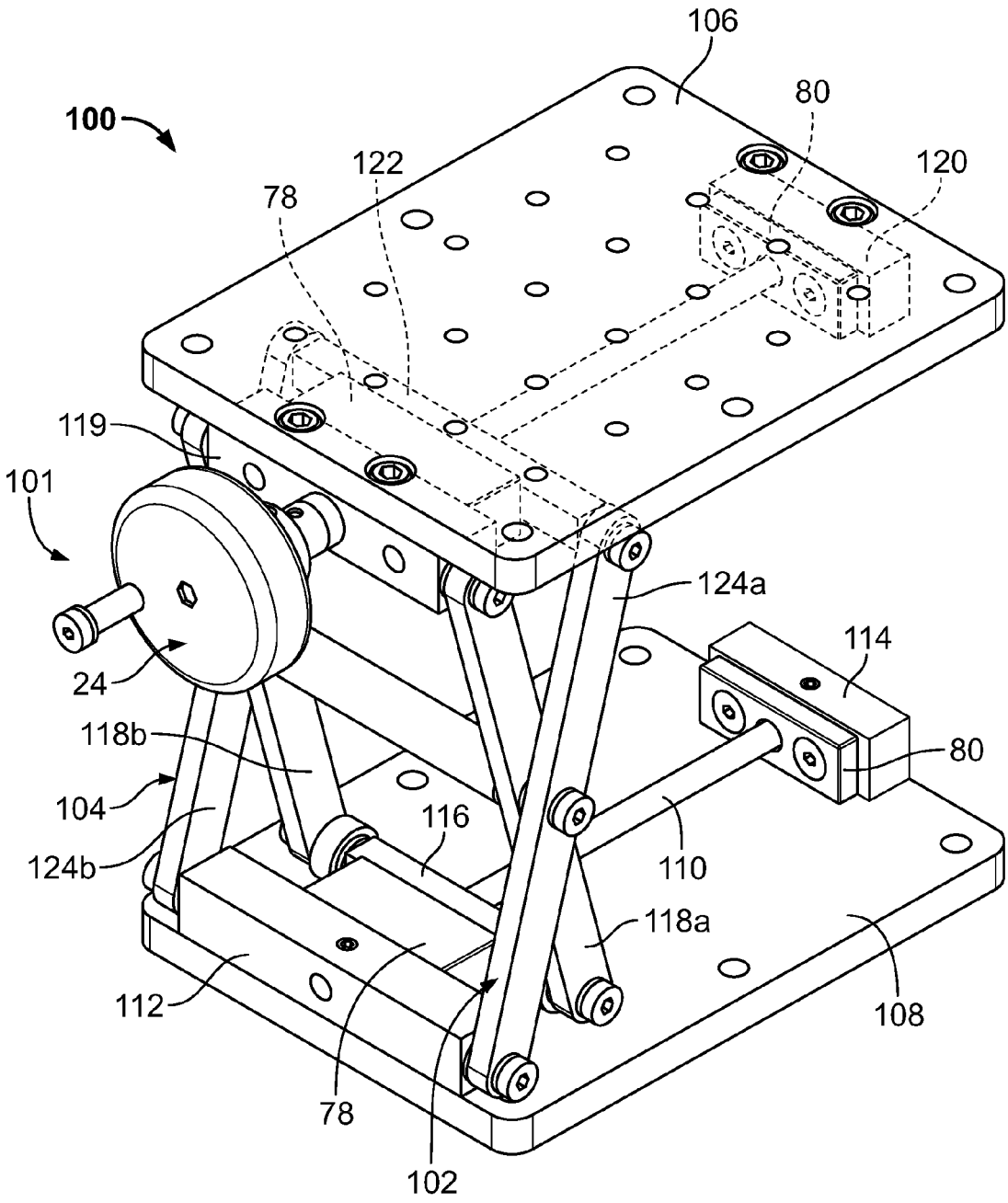
FIG. 6 is an isometric view of another embodiment of the laboratory jack of the present invention in a fully extended, maximum height position.

Turning now to the drawings, one embodiment is shown in FIGS. 2 through 5 and a second embodiment is shown in FIG. 6. The invention, however, is not limited to the exact details of the embodiments described herein.

Figure 2:
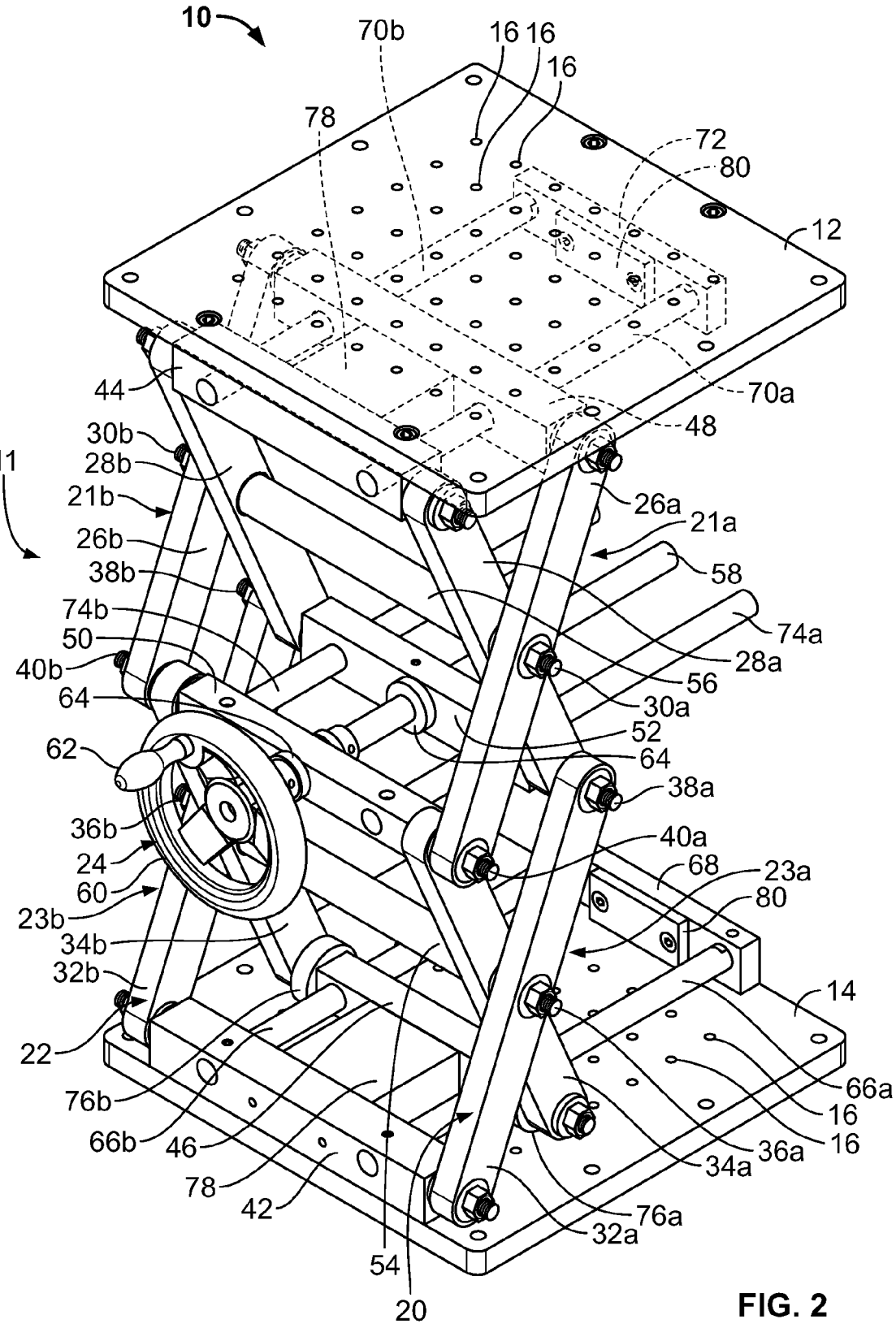
FIG. 2 is an isometric view of one embodiment of a laboratory jack of the present invention in a fully extended, maximum height position.
Figure 3:
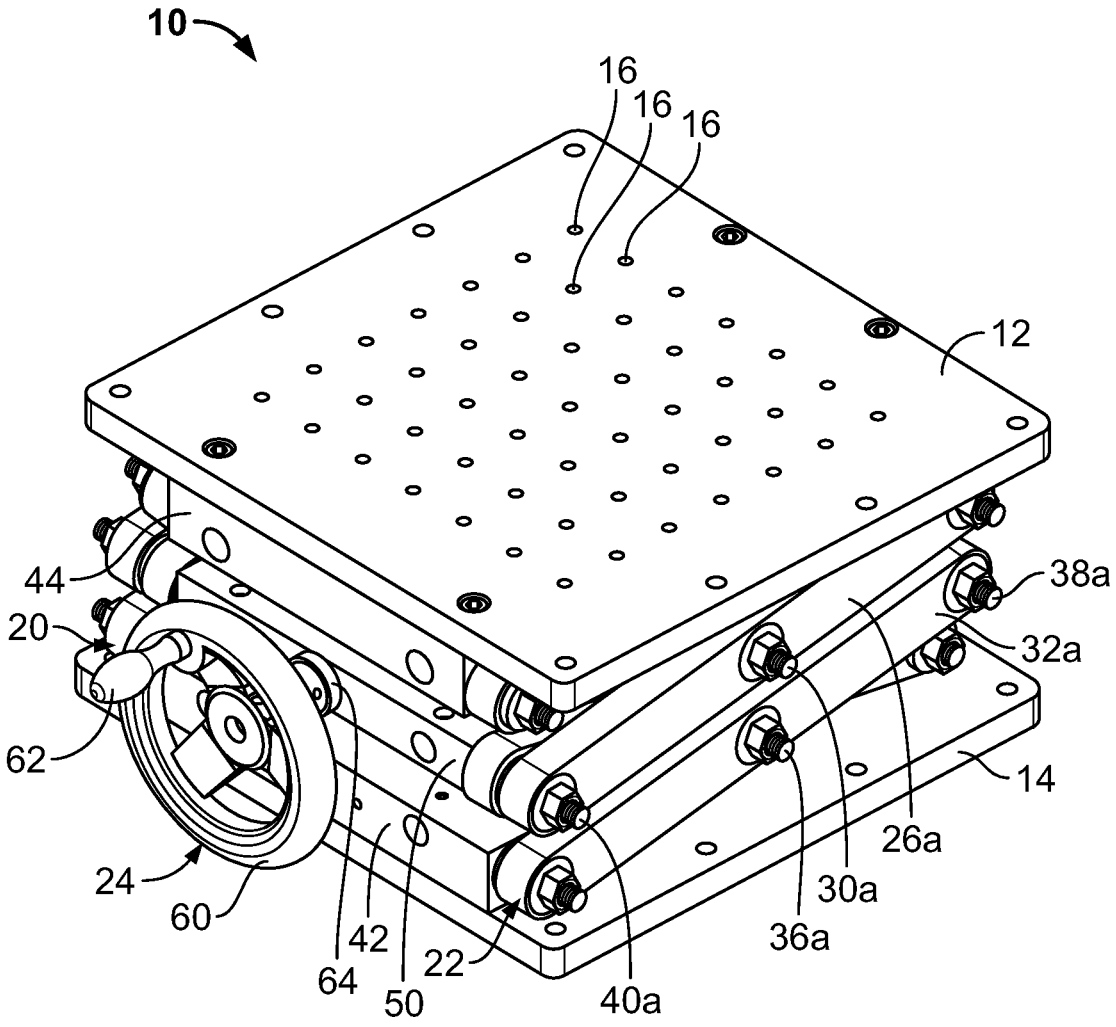
FIG. 3 is an isometric view of the laboratory jack of FIG. 2 in a fully retracted, minimum height position.

As most clearly seen in FIG. 2 and with appropriate reference to FIGS. 3, 4, and 5 as helpful, a laboratory jack 10 includes a scissors jack assembly 11 disposed between and connected at opposite upper and lower ends thereof to a top support plate 12 and a bottom support plate 14. It should be noted that all directional references, e.g., up, down, left, and right, are used for convenience with references to the drawings as depicted herein and should not otherwise be considered as limitations on the description. The scissors jack assembly 11 is capable of shifting the top support plate 12 vertically up and down with respect to the bottom support plate 14 in a controlled manner between a minimum height position shown in FIG. 3 and a maximum height position shown in FIG. 2.

Each of the top support plate 12 and the bottom support plate 14 has an array of connectors, such as bore holes 16, for receiving anchoring devices to securely attach a load to the respective support plate. Preferably, each support plate 12, 14 is substantially planar and the bore holes 16 are threaded so as to receive complementary threaded bolts or screws therein. As shown in FIG, 2, the top support plate 12 has a rectangular 7×7 array of threaded bore holes spaced at 1 inch on center, and the bottom support plate 14 likewise includes a 7×7 array of threaded bore holes (partially visible) spaced at 25 mm on center. In this manner, the top support plate 12 is adapted for use with English based measurement systems, and the bottom support plate 14 is adapted for use with metric based measurement systems. Importantly it should be noted that the laboratory jack 10 may be placed in the position shown in FIG. 2 or may just as easily be inverted such that the top support plate 12 acts as a base and the bottom support plate 14 acts as a loading platform. Thus, the laboratory jack 10 is preferably substantially, though not necessarily exactly, symmetrical about a horizontal center plane between the top and bottom support plates 12, 14 with only minor variations, such as to accommodate slightly different sized components if desired. Further, other arrangements of the bore holes 16 may be used as deemed expedient or necessary for any particular application and is not limited to the particular arrays disclosed and shown and described herein. The bore holes 16 may be through bore holes, which extend all the way through the respective support plates, or may be blind bore holes, which do not extend all the way through the support plate. It should be noted that the laboratory jack 10 is particularly well adapted to be supported by a horizontal level surface, such as a laboratory table or similar support surface, such that the motion of movement of the scissors jack assembly 11 is substantially up and down in a vertical direction perpendicular to the level support surface.

The scissors jack assembly 11 has a right linear actuator column 20 and a left linear actuator column 22 and a drive sub-assembly 24. The right linear actuator column 20 is substantially identical to the left linear actuator column 22 as a mirror image thereof about a center plane extending between the left and right linear actuator columns. Right linear actuator column 20 has two pairs of scissor assemblies, including an upper scissor assembly 21*a* and a lower scissor assembly 23*a*. Likewise, left linear actuator column 22 has two pairs of scissor assemblies, including an upper scissor assembly 21*b* and a lower scissor assembly 23*b*, respectively. Upper scissor assemblies 21*a* and 21*b* include upper scissor arms 26*a*, 28*a* and 26*b*, 28*b*, respectively. Similarly, lower scissor assemblies 23*a* and 23*b* include lower scissor arms 32*a*, 34*a* and 32*b*, 34*b*, respectively.

With reference to the right linear actuator column 20, the upper scissor arms 26*a*, 28*a* cross preferably at the mid-points thereof and are pivotably connected to each other at the crossing point by pivot connector 30*a*, such as a pin, bolt, or similar connector. Similarly, the lower scissor arms 32*a*, 34*a* also cross preferably at the mid-points thereof and are pivotably connected to each other by pivot connector 36*a*. In addition, the upper ends of the lower scissor arms 32*a*, 34*a* are also pivotably connected to the respective lower ends of the upper scissor arms 26*a*, 28*a* by respective pivot connectors 38*a* and 40*a*, Thus, the upper scissor arms 26*a*, 28*a* and lower scissor arms 32*a*, 34*a* form what appear to be an upper "X" connected to a lower "X," each of which can pivot about the various pivot connectors 30*a*, 36*a*, 38*a*, and 40*a* to extend and retract in the vertical direction between the maximum height position shown in FIG. 2 and the minimum height position shown in FIG. 3.

The left linear actuator column 22 similarly includes upper scissor arms 26*b*, 28*b* and lower scissor arms 32*b*, 34*b* that are pivotably interconnected at their upper and lower ends and to each other by pivot connectors 30*b*, 36*b*, 38*b*, and 40*b* in substantially the same manner as described with respect to the right linear actuator column 20. The lower ends of lower scissor arms 32*a*, 32*b* are further pivotably connected to opposite ends of a mounting block 42, which is in turn fixedly attached. to the bottom support plate 14 along one edge thereof. The upper ends of upper arms 28*a*, 28*b* are pivotably connected to opposite ends of a mounting block 44, which is in turn fixedly connected to the top support plate 12. A mounting block 46 extends between and is pivotably connected to the lower ends of lower scissor arms 34*a* and 34*b*. The lower ends of lower scissor arms 34*a*, 34*b* are moveably connected with the bottom support plate 14 via the mounting block 46 such that the lower ends may travel laterally in translation across the bottom support plate 14 toward and away from the lower ends of the lower scissor arms 32*a*, 32*b*, which are retained in a fixed position with respect to the bottom support plate 14 by the mounting block 42. Similarly, a mounting block 48 extends between and is pivotably connected to the upper ends of the upper scissor arms 26*a* and 26*b*. The upper ends of the upper scissor arms 26*a*, 26*b* are moveably connected with the top support plate 12 via the mounting block 48 such that the upper ends of the upper scissor arms 26*a*, 26*b* can travel laterally in translation toward and away from the upper ends of the upper scissor arms 28*a*, 28*b*, which are fixedly maintained in position with respect to the top support plate 12 by the mounting block 44.

The left linear actuator column 22 and the right linear actuator column 20 are functionally connected with each other by a series of cross-bracing members, including mounting blocks 42, 44, 46, and 48 as previously described herein, center drive mounting blocks 50 and 52, and lower and upper joining rods 54 and 56. Preferably, each cross-bracing member extends between and connects opposing identical portions of the left linear actuator column 22 and the right linear actuator column 20. Thus, the lower joining rod 54 extends between the lower scissor arms 32*a*, 34*a* and the lower scissor arms 32*b*, 34*b* and also pivotally connects the lower scissor arm 32*a* to the lower scissor arm 34*a* and pivotally connects lower scissor arm 32*b* to lower scissor arm 34*b*. The center drive mounting block 50 pivotally connects the upper end of lower scissor arm 34*a* to the lower end of upper scissor arm 26*a* and pivotally connects the upper end of lower scissor arm 34*b* with the lower end of upper scissor arm 26*b*. The center drive mounting block 52 pivotally connects the lower end of the upper scissor arm 28*a* to the upper end of the lower scissor arm 32*a* and pivotably connects the lower end of the upper scissor arm 28*b* to the upper end of lower scissor arm 32*b*. Upper joining rod 56 and mounting blocks 44 and 48 extend between and pivotably interconnect to the upper scissor arms 26*a*, 28*a*, and 26*b*, 28*b* in the same manner as described to the corresponding members between the lower scissor arms 32, 34 and shown in FIG. 2. Preferably all of the pivot connections between the scissor arms and the mounting blocks and joining rods are affected by shafts or pins that project from the ends of the mounting blocks or formed by the joining rods, through bore holes in the respective ends of the scissor arms and secured thereon with appropriate fasteners, such as nuts, pins, or other suitable fasteners. Further, the pivot connections preferably includes radial bearings and thrusts bearings and appropriate spacers, such as washers, in a manner that would be apparent to one skilled in the art so as to provide smooth and efficient pivot connections.

The drive sub-assembly 24 is preferably a linear drive mechanism that is adapted to urge the center drive mounting blocks 50 and 52 together and/or apart in a controlled manner so as to force the scissors jack assembly 11 to expand and retract in a manner well understood in the art. In one embodiment, the drive sub-assembly 24 includes a rotational actuator attached to and end of a threaded rod which extends through a bore hole centrally located in each of the center drive mounting blocks 50 and 52. The rotational actuator in this embodiment includes a hand-wheel 60 and a handle 62 extending out from the hand-wheel for grasping by user. Other rotational drive mechanisms may also or alternatively contemplated, such as an electric motor, servo drive motor, or other suitable rotational drive means. The threaded rod 58 preferably is carried by bushings 64 in each of the center drive mounting blocks 50 and 52 in order to reduce friction and improve the drive response of the drive sub-assembly 24. In one embodiment, the threaded rod 58 has a single direction of threads and the bushing or through bore of the center drive mounting block 52 includes complimentary threads for engagement with the threaded rod 58, whereas the through bore and bushing of the center drive mounting block 50 is unthreaded. The threaded rod 58 is maintained in its lateral position with respect to the center drive mounting block 50 by appropriate locking mechanisms, such as washers, bushings, and locking pins, or the like, such that when the hand wheel 60 is rotated the threaded rod 58 will urge the center drive mounting block 52 laterally toward or away from the center drive mounting block 50 depending on which direction the hand wheel 60 is rotated. Other linear drive assemblies could also be used to urge the center drive mounting blocks 50, 52 together and apart, such as hydraulic or pneumatic pistons, and the like.

The laboratory jack 10 further includes three levels of guide assemblies, one guide assembly at each level of the ends of the scissors assemblies, which maintain the scissors jack assembly 11 in alignment along the direction of extension and retraction movement so as to prevent unwanted twisting of the scissors jack assembly 11. Each guide assembly includes a pair of parallel spaced apart guide rods disposed between the right and left linear actuator columns 20, 22 and aligned with the ends of the various scissor arms, thereby forming a lower level guide assembly, a middle level guide assembly, and an upper level guide assembly.

The lower level guide assembly includes parallel spaced apart guide rods 66*a* and 66*b* disposed between the lower ends of lower scissor arms 32*a*, 32*b* and 34*a*, 34*b*. The guide rods 66*a*, 66*b* are carried by and between the mounting block 42 and a mounting block 68 and are spaced apart from the bottom support plate 14 and attached thereto. The guide rods 66*a*, 66*b* are parallel to the direction of travel of the lower ends of the lower scissor arms 34*a*, 34*b* and extend through respective through bores in the mounting block 46, whereby the mounting block 46 can slide toward and away from the mounting block 42 as the lower ends of lower scissor arms 34*a*, 34*b* are urged toward and away from the lower ends of the lower scissor arms 32*a*, 32*b* in response to actuation of the drive sub-assembly 24.

The upper level guide assembly includes a substantially identical set of guide rods 70*a* and 70*b* that are carried by the mounting block 44 and a mounting block 72, which are attached to the top support plate 12, for guiding the upper ends of the upper scissor arms 26*a*, 26*b* and 28*a*, 28*b* in a substantially identical manner as described with regard to the lower level guide assembly.

The middle level guide assembly includes a set of guide rods 74*a*, 74*b* that are disposed through and carried by the center drive mounting blocks 50 and 52. One end of the guide rods 74*a*, 74*b* is fixedly carried by the center drive mounting block 50, and the center drive mounting block 52 includes through bores through which the guide rods 74*a*, 74*b* extend such that the center drive mounting block 52 can slide toward and away from the center drive mounting block 50 on the guide rods 74*a*, 74*b*. Further, the guide rods 74*a*, 74*b* travel up and down with the center drive mounting blocks 50 and 52 as the scissors jack assembly 11 is extended and retracted.

The guide assemblies are not limited to having only two guide rods as shown in FIGS. 2-5, and may include more or fewer guide rods at each level of the scissors jack assembly 11 aligned parallel to the direction of lateral travel of the ends of the various respective scissor arms. The guide rods 66*a*, 66*b*, 70*a*, 70*b*, and 74*a*, 74*b* are all substantially parallel with the direction of motion of the ends of the upper and lower arms in a manner that maintains the entire scissors jack assembly 11 in alignment. The addition of guide rods 74*a*, 74*b* at a central level parallel with the junctions of the upper scissor arms and the lower scissor arms provides additional stability to the entire scissors jack assembly 11 through the entire range of motion from the minimum height position to the maximum height position and thereby allows additional load capacity and a larger travel distance over the prior art laboratory jacks.

Preferably rollers are disposed near the interface between the ends of the laterally shiftable scissor arms and the respective top or bottom plates 12, 14 such that the laterally shiftable ends roll across the respective plate rather than slide thereacross. In one embodiment, wheels or casters 76*a* and 76*b*, are pivotably carried on opposite ends of each of the mounting blocks 46 and 48 to ride on the bottom support plate 14 and top support plate 12 respectively to reduce frictional forces between the guide rods 66*a*, 66*b*, 70*a*, 70*b*, and the respective mounting blocks 46 and 48. Further spacing the guide rods 66*a* and 66*b* from the bottom support plate 14 and spacing the guide rods 70*a* and 70*b* from the top support plate 12 increases the structural integrity of the entire assembly to help prevent unwanted deformation of the support plate, such as bending and/or twisting, by increasing the moments of inertia.

Each of the top support plate 12 and bottom support plate 14 may further include a pair of stop blocks including an upper limit stop block 78 and a lower limit stop block 80. In one embodiment, the upper limit stop block 78 is disposed against and/or carried by the mounting block 42 and engages the mounting block 46 when the scissors jack assembly 11 has reached its maximum height, most extended position, thereby preventing the scissors jack assembly 11 from extending any further. In a similar manner the lower limit stop block 80 is disposed against and/or carried by the mounting block 68 and engages the mounting block 46 when the scissors jack assembly 11 has been retracted to its lowest desired position thereby preventing the mounting block 46 from further travel away from the mounting block 42. Similarly, upper and lower limit stop blocks may be carried by the top support plate 12 and/or the mounting blocks 44 and 72 to stop the mounting block 48 at the upper and lower limits of travel of the scissors jack assembly 11. Clearly the amount of travel capable by the scissors jack assembly 11 may be increased or decreased within obvious geometric limits by positioning the upper and lower limit stop blocks 78, 80 closer or further apart from each other.

The laboratory jack 10 is preferably made of a strong, rigid material, such as steel, and the constituent parts may be formed in any suitable manner, such as by machining. Other materials and manufacturing methods may also be used, such as molded plastics, as would be apparent to the skilled artisan.

Some advantages of the laboratory jack 10 described herein is the ability to move at least a complete 12 inches in the vertical direction, whereas other prior art laboratory jacks tend to have much shorter ranges of motion and would need to be ganged or stacked two, three, or four times to achieve a full 12 inches of movement. Further the increased stability obtained by using the three levels of guide rods as described herein and machined metal parts allows the entire laboratory jack to have a load weight capacity in some instances between 100-150 lbs. when moving and 200 lbs, in a static position. Further, the design of the parts minimizes the deflection or in some instances approximately +/−0.015 inches over the entire range of motion of the laboratory jack. In one embodiment, the top support plate and the bottom support plate are 9½ inches×9½ inches square and approximately 1 inch thick.

The invention is not limited to the two-tier scissors jack assembly described with respect to the laboratory jack 10. Another embodiment of a laboratory jack is shown in FIG. 6. The laboratory jack 100 has a scissors jack assembly 101 comprising a single tier of paired right and left scissor assemblies 102, 104 that are connected to top and bottom support plates 106, 108. Right scissor assembly 102 includes scissor arms 118*a* and 124*a*, and left scissor assembly 104 includes scissor arms 118*b* and 124*b*.

In this embodiment, the laboratory jack 100 includes a single guide rod 110 carried in spaced apart relation to the bottom support plate 108 by mounting blocks 112 and 114 at opposite ends of the direction of travel of the moving lower ends of scissor arms 118*a* and 118*b* of the scissors assemblies 102, 104. A mounting block 116 is disposed between and pivotably connected to the lower ends of scissor arms 118*a* and 118*b*, which move in lateral translation across the bottom support plate 108. The guide rod 110 extends through a through bore hole in the mounting block 116, whereby the guide rod 110 allows the mounting block 116 to also move back and forth laterally across the bottom support plate 108 and prevents the mounting block 116 from moving transverse to the direction of movement of the lower ends of the scissor arms 118*a* and 118*b*. The linear drive sub-assembly 24 is carried by spaced apart mounting blocks 119 and 120 attached to the top support plate 106 and extend though a mounting block 122 disposed between and pivotably connected to upper ends of laterally movable scissor arms 124*a* and 124*b* of the scissor assemblies 102, 104. In this instance, the linear drive sub-assembly 24 both drives extension and retraction of the scissor jack assembly 101 and guides the upper ends of the laterally movable scissor arms 124*a* and 124*b;* and the single guide rod 110 guides the lower ends of the laterally movable scissor arms 118*a* and 118*b* of the scissor assemblies 102, 104.

The laboratory jack 100 may also include upper and lower limit stop blocks 78 and 80 as shown in FIG. 6. Either or both mounting blocks 112 and 119 may carry the upper limit stop block 78 and, either or both mounting blocks 114 and 120, may carry the lower limit stop block 80.

Each of the laboratory jacks 10, 100 disclosed herein is particularly useful for moving a load up and down in a highly controlled and precise manner for laboratory applications, and maintaining the load in a selected vertical position. The laboratory jacks according to some aspects of the invention provide improved stability and precision of movement and location over a larger range of motion than previously known laboratory jacks.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

I claim:

1. A laboratory jack comprising:

a first support plate;

a second support plate;

a scissors jack assembly disposed between and connected to the first and second support plates, the scissors jack assembly comprising at least a first scissor assembly and a second scissor assembly, the first and second scissor assemblies being substantially identical, spaced apart, and parallel to each other, and first and second connection members spaced apart and connecting opposing positions on the first and second scissor assemblies, wherein the first connection member comprises a first mounting block fixedly attached to at least one of the first support plate and the second support plate;

a linear drive operatively connected to the scissors jack assembly actuating the scissors jack assembly to drive the second support plate toward and away from the first support plate in a vertical direction; and a guide member extending from the first connection member to the second connection member, the guide member spaced between the first scissors assembly and the second scissors assembly, the guide member fixedly attached to the first connection member on one end and movably attached to the second connection member, wherein the second connection member slides along the guide member as the scissors jack assembly lowers or raises the second support plate.

2. The laboratory jack of claim 1, wherein the guide member extends through a bore hole associated with the second connection member.

3. The laboratory jack of claim 2, wherein the linear drive comprises the guide member.

4. The laboratory jack of claim 1, wherein the end of the guide member opposite the end that is fixedly attached to the first mounting block is attached to a second mounting block such that the second connection member slides between the first mounting block and the second mounting block.

5. The laboratory jack of claim 1, wherein the linear drive is substantially parallel to, spaced apart from and between the first and second scissor assemblies, and in the same linear plane as the guide member.

6. A laboratory jack comprising:

a base platform;

a load platform;

a scissors jack assembly disposed between and connected to the base platform and the load platform for lowering and raising the load platform from the base platform in a vertical direction, the scissors jack assembly comprising a first linear actuator column spaced apart from a second linear actuator column, the first linear actuator column comprising a first upper scissor assembly operatively connected to a first lower scissor assembly, the second linear actuator column comprising a second upper scissor assembly operatively connected to a second lower scissor assembly, and first and second cross-brace members spaced apart and connecting the first linear actuator column with the second linear actuator column at the connections of the lower scissor assemblies to the upper scissor assemblies;

a linear drive associated with the scissors jack assembly and aligned transverse to the vertical direction, wherein actuation of the linear drive causes the scissors jack assembly to raise or lower the load platform;

a first guide member extending from the first cross-brace member to the second cross-brace member, the first guide member fixedly attached to the first cross-brace member and extending through a bore hole associated with the second cross-brace member, wherein the second cross-brace member slides along the first guide member as the scissors jack assembly lowers or raises the load platform; and a second guide member extending from the first cross-brace member to the second cross-brace member parallel to and spaced apart from the first guide member, the second guide member fixedly attached to the first cross-brace member and extending through a second bore hole associated with the second cross-brace, wherein the second cross-brace member slides along the second guide member as the scissors jack assembly lowers or raises the load platform; and wherein the linear drive is carried by the first and second cross-brace members.

7. The laboratory jack of claim 6, wherein the linear drive is disposed between and parallel to the first and second guide members.

8. The laboratory jack of claim 6, wherein the linear drive comprises a worm gear that urges the first cross-brace member toward and away from the second cross-brace member.

9. The laboratory jack of claim 6, wherein the base platform comprises a first array of connectors for connecting to a load, the first array spaced apart in a first measurement system, and a support platform comprises a second array of connectors for connecting to a load, the second array spaced apart in a second measurement system.

10. The laboratory jack of claim 9, wherein the laboratory jack is substantially symmetrical about a horizontal center plane between the base platform and the load platform, whereby the laboratory jack is functionally operational when inverted about the horizontal center plane for supporting a load on either the support platform or the base platform.

11. The laboratory jack of claim 6, wherein one or more connections between the upper and lower scissor assemblies comprise thrust bearings.

12. The laboratory jack of claim 6, comprising a roller carried by opposing movable ends of the first and second lower scissor assemblies, the roller engaging the base platform, wherein the movable ends of the first and second lower scissor assemblies travel laterally across the base platform on the roller.

13. A laboratory jack comprising:

a first support plate;

a second support plate;

a scissors jack assembly disposed between and connected to the first and second support plates, the scissors jack assembly comprising at least a first scissor assembly and a second scissor assembly, the first and second scissor assemblies being substantially identical, spaced apart, and parallel to each other and connected by a first cross-brace member and a second cross-brace member, wherein the first cross-brace member is adjacent the first support plate and connects a non-translating end of the first scissor assembly with a non-translating end of the second scissor assembly and connects opposing positions on the first and second scissor assemblies, wherein the second cross-brace member adjacent the first support plate and connecting a translating end of the first scissor assembly with translating end of the second scissor assembly, and a guide rod connected to the first cross-brace member and extending through a through bore associated with the second cross-brace member, and wherein the guide rod is spaced apart from the first support plate;

a drive member for actuating the scissors jack assembly to drive the second support plate toward and away from the first support plate in a vertical direction; and a roller associated with the first scissor assembly, the roller disposed at a laterally translating interface between the first scissor assembly and the first support plate, wherein the scissor assembly rolls across the first support plate on the roller, and wherein the roller is carried by the second cross-brace member.

* * * * *